US007182141B2

(12) United States Patent
Tran et al.

(10) Patent No.: US 7,182,141 B2
(45) Date of Patent: Feb. 27, 2007

(54) EXPANDER TOOL FOR DOWNHOLE USE

(75) Inventors: Khai Tran, Pearland, TX (US); Clayton Plucheck, Tomball, TX (US)

(73) Assignee: Weatherford/Lamb, Inc., Houston, TX (US)

( * ) Notice: Subject to any disclaimer, the term of this patent is extended or adjusted under 35 U.S.C. 154(b) by 0 days.

(21) Appl. No.: 10/267,025

(22) Filed: Oct. 8, 2002

(65) Prior Publication Data

US 2004/0065446 A1 Apr. 8, 2004

(51) Int. Cl.
*E21B 23/02* (2006.01)

(52) U.S. Cl. ..... 166/384; 166/207

(58) Field of Classification Search ..... 166/384, 166/380, 207, 253.1, 255.2, 382
See application file for complete search history.

(56) References Cited

U.S. PATENT DOCUMENTS

| | | | | |
|---|---|---|---|---|
| 761,518 | A | | 5/1904 | Lykken |
| 1,324,303 | A | | 12/1919 | Carmichael |
| 1,545,039 | A | | 7/1925 | Deavers |
| 1,561,418 | A | | 11/1925 | Duda |
| 1,569,729 | A | | 1/1926 | Duda |
| 1,597,212 | A | | 8/1926 | Spengler |
| 1,930,825 | A | | 10/1933 | Raymond |
| 2,383,214 | A | | 8/1945 | Prout |
| 2,499,630 | A | | 3/1950 | Clark |
| 2,575,938 | A | * | 11/1951 | Brenneke ..... 72/75 |
| 2,627,891 | A | | 2/1953 | Clark |
| 2,663,073 | A | | 12/1953 | Bieber et al. |
| 2,898,971 | A | | 8/1959 | Hempel |
| 3,087,546 | A | | 4/1963 | Wooley |
| 3,186,485 | A | | 6/1965 | Owen |
| 3,191,677 | A | | 6/1965 | Kinley |
| 3,195,646 | A | | 7/1965 | Brown |

(Continued)

FOREIGN PATENT DOCUMENTS

| | | |
|---|---|---|
| CA | 2 406 490 | 4/2003 |

(Continued)

OTHER PUBLICATIONS

International Search Report, International Application No. PCT/GB 02/03827, dated Dec. 4, 2002.

(Continued)

*Primary Examiner*—William Neuder
(74) *Attorney, Agent, or Firm*—Patterson & Sheridan, L.L.P.

(57) ABSTRACT

An expander tool for expanding a first tubular into a second surrounding tubular within a wellbore. The expander tool first comprises a body. Within the body is an expansion member capable of being actuated outwardly from the body when expansion of the first tubular is desired. In one aspect, the expander tool is a rotary expander tool, and the expansion members define a plurality of rollers. The expander tool further comprises at least one sensor for sensing a downhole condition during expansion of the tubular. The sensors in one aspect include at least one tool for sensing wall dimensions of the first tubular such as inner diameter or wall thickness. Examples include sonic logs, caliper logs, and electromagnetic wall thickness tools. A depth gauge may also be included. In one aspect, a data transmission device is provided between a surface server and the sensors downhole. In this way, the operator at the surface can monitor progress of the expansion operation downhole.

21 Claims, 6 Drawing Sheets

U.S. PATENT DOCUMENTS

| | | | | | |
|---|---|---|---|---|---|
| 3,203,483 | A | * | 8/1965 | Vincent | 166/207 |
| 3,208,531 | A | | 9/1965 | Tamplen | |
| 3,385,369 | A | * | 5/1968 | Saurenman | 166/319 |
| 3,412,565 | A | | 11/1968 | Lindsey et al. | |
| 3,467,180 | A | | 9/1969 | Pensotti | |
| 3,498,376 | A | | 3/1970 | Sizer et al. | |
| 3,669,190 | A | | 6/1972 | Sizer et al. | |
| 3,712,376 | A | | 1/1973 | Owen et al. | |
| 3,746,091 | A | | 7/1973 | Owen et al. | |
| 3,776,307 | A | | 12/1973 | Young | |
| 3,818,734 | A | | 6/1974 | Bateman | |
| 3,911,707 | A | | 10/1975 | Minakov et al. | |
| 3,948,321 | A | | 4/1976 | Owen et al. | |
| 4,069,573 | A | | 1/1978 | Rogers, Jr. et al. | |
| 4,127,168 | A | | 11/1978 | Hanson et al. | |
| 4,159,564 | A | | 7/1979 | Cooper, Jr. | |
| 4,288,082 | A | | 9/1981 | Setterberg, Jr. | |
| 4,292,588 | A | * | 9/1981 | Smith | 324/221 |
| 4,324,407 | A | | 4/1982 | Upham et al. | |
| 4,429,620 | A | | 2/1984 | Burkhardt et al. | |
| 4,531,581 | A | | 7/1985 | Pringle et al. | |
| 4,588,030 | A | | 5/1986 | Blizzard | |
| 4,697,640 | A | | 10/1987 | Szarka | |
| 4,848,469 | A | | 7/1989 | Baugh et al. | |
| 4,980,682 | A | * | 12/1990 | Klein et al. | 340/854.6 |
| 5,130,705 | A | * | 7/1992 | Allen et al. | 340/853.9 |
| 5,271,472 | A | | 12/1993 | Leturno | |
| 5,398,754 | A | | 3/1995 | Dinhoble | |
| 5,409,059 | A | | 4/1995 | McHardy | |
| 5,409,060 | A | | 4/1995 | Carter | |
| 5,435,400 | A | | 7/1995 | Smith | |
| 5,472,057 | A | | 12/1995 | Winfree | |
| 5,533,573 | A | | 7/1996 | Jordan, Jr. et al. | |
| 5,560,426 | A | | 10/1996 | Trahan et al. | |
| 5,685,369 | A | | 11/1997 | Ellis et al. | |
| 5,901,787 | A | | 5/1999 | Boyle | |
| 6,006,834 | A | * | 12/1999 | Skinner | 166/250.17 |
| 6,012,516 | A | | 1/2000 | Brunet | |
| 6,021,850 | A | | 2/2000 | Wood et al. | |
| 6,098,717 | A | | 8/2000 | Bailey et al. | |
| 6,186,233 | B1 | | 2/2001 | Brunet | |
| 6,325,148 | B1 | | 12/2001 | Trahan et al. | |
| 6,425,444 | B1 | | 7/2002 | Metcalfe et al. | |
| 6,446,323 | B1 | | 9/2002 | Metcalfe et al. | |
| 6,457,532 | B1 | | 10/2002 | Simpson | |
| 6,478,091 | B1 | * | 11/2002 | Gano | 166/373 |
| 6,488,095 | B2 | | 12/2002 | Buytaert | |
| 6,561,271 | B2 | * | 5/2003 | Baugh et al. | 166/285 |
| 6,789,621 | B2 | * | 9/2004 | Wetzel et al. | 166/253.1 |
| 6,799,637 | B2 | * | 10/2004 | Schetky et al. | 166/384 |
| 2001/0020532 | A1 | | 9/2001 | Baugh et al. | |
| 2001/0045284 | A1 | * | 11/2001 | Simpson et al. | 166/313 |
| 2002/0145281 | A1 | | 10/2002 | Metcalfe et al. | |
| 2002/0166668 | A1 | | 11/2002 | Metcalfe et al. | |
| 2003/0056947 | A1 | | 3/2003 | Cameron | |
| 2003/0075323 | A1 | * | 4/2003 | Vercaemer et al. | 166/277 |
| 2003/0075339 | A1 | * | 4/2003 | Gano et al. | 166/380 |
| 2003/0111234 | A1 | * | 6/2003 | McClurkin et al. | 166/384 |

FOREIGN PATENT DOCUMENTS

| | | | |
|---|---|---|---|
| CA | 2 446 115 | | 4/2003 |
| CA | 2 414 432 | | 6/2003 |
| EP | 0 961 007 | A2 | 12/1999 |
| EP | 1 306 519 | | 5/2003 |
| GB | 2 320 734 | A | 7/1998 |
| GB | 2 345 308 | A | 7/2000 |
| GB | 2 379 690 | A | 3/2003 |
| GB | 2 381 021 | A | 4/2003 |
| GB | 2 386 625 | A | 9/2003 |
| WO | WO 93/24728 | | 12/1993 |
| WO | WO 99/18328 | | 4/1999 |
| WO | WO 99/23354 | | 5/1999 |
| WO | WO 00/37766 | | 6/2000 |
| WO | WO 00/37767 | | 6/2000 |
| WO | WO 00/37768 | | 6/2000 |
| WO | WO 00/37772 | | 6/2000 |
| WO | WO 00/37773 | | 6/2000 |
| WO | WO 01/60545 | A1 | 8/2001 |
| WO | WO 03/004819 | A3 | 1/2003 |
| WO | WO 03/042486 | A3 | 5/2003 |

OTHER PUBLICATIONS

U.S. Appl. No. 10/349,432, filed Jan. 22, 2003, Tran et al.
U.S. Appl. No. 10/034,592, filed Dec. 28, 2001, Lauritzen et al.
U.S. Appl. No. 10/253,114, filed Sep. 24, 2002, Maguire et al.
U.S. Appl. No. 09/469,643, filed Dec. 22, 1999, Metcalfe et al.
U.K. Search Report, Application No. GB 0323610.6, dated Dec. 19, 2003.
Candian Office Action, Application No. 2,444,756, dated Sep. 12, 2005.
U.K. Examination Report, Application No. GB0323610.6, dated Jun. 22, 2005.

* cited by examiner

Fig. 2
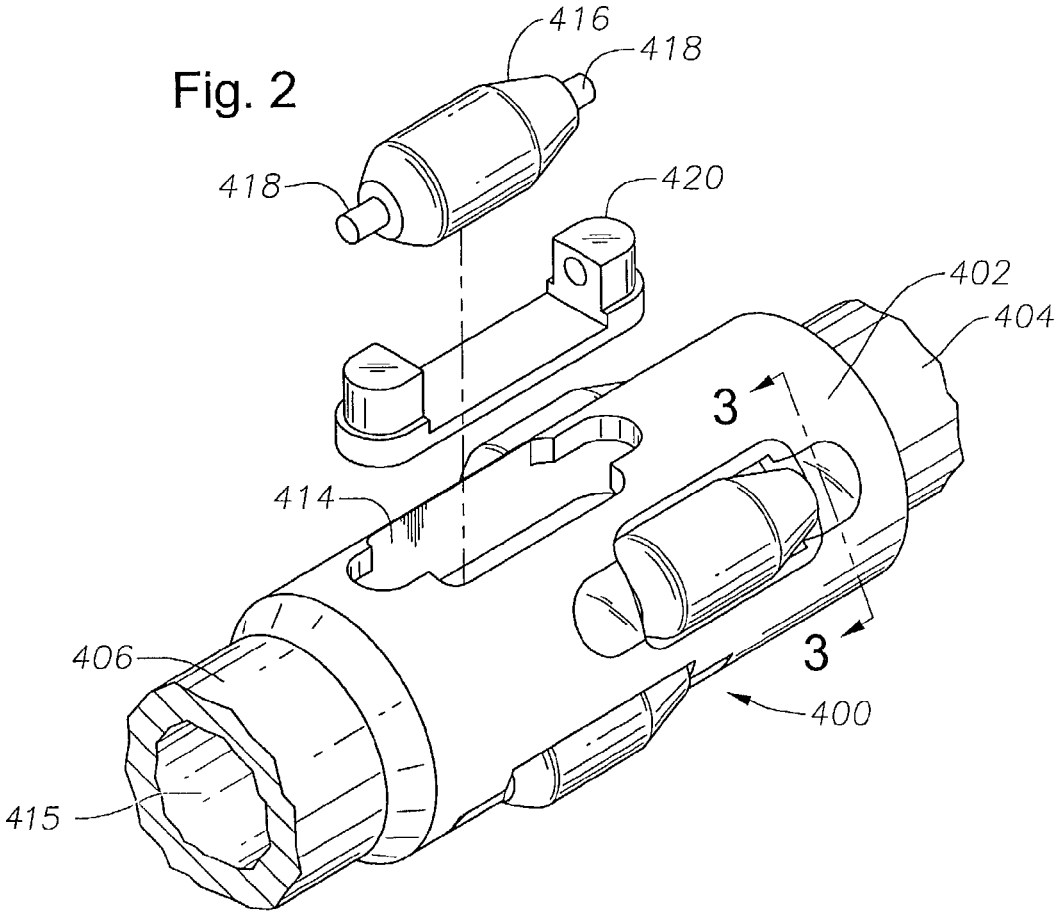
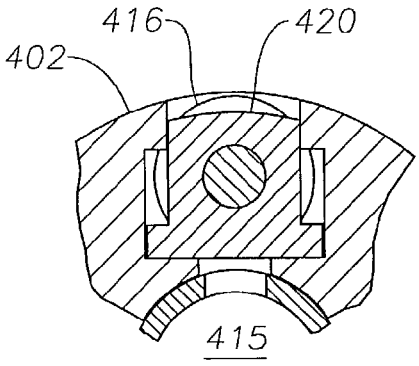
Fig. 3
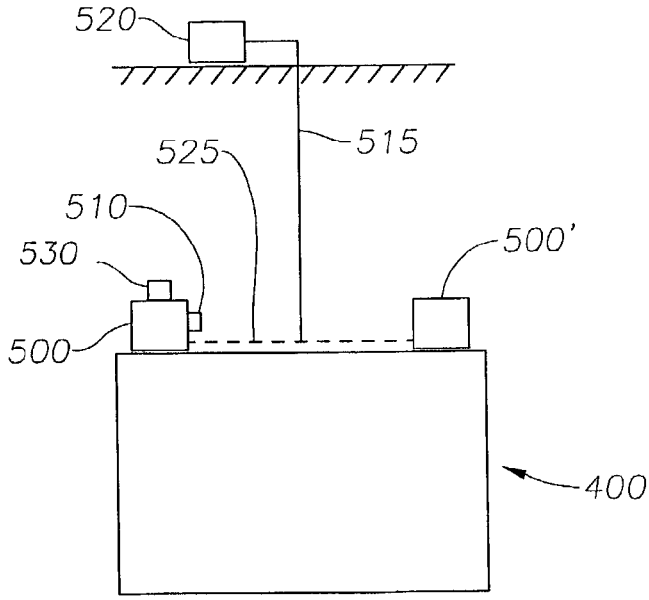
Fig. 5

EXPANDER TOOL FOR DOWNHOLE USE

BACKGROUND OF THE INVENTION

1. Field of the Invention

The present invention relates to an apparatus for use during wellbore completion. More particularly, the invention relates to an improved expander tool for expanding tubular bodies downhole.

2. Description of the Related Art

Hydrocarbon and other wells are completed by forming a borehole in the earth and then lining the borehole with steel pipe or casing to form a wellbore. After a section of wellbore is formed by drilling, a section of casing is lowered into the wellbore and temporarily hung therein from the surface of the well. Using apparatus known in the art, the casing is cemented into the wellbore by circulating cement into the annular area defined between the outer wall of the casing and the borehole. The combination of cement and casing strengthens the wellbore and facilitates the isolation of certain areas of the formation behind the casing for the production of hydrocarbons.

It is common to employ more than one string of casing in a wellbore. In this respect, a first string of casing is set in the wellbore when the well is drilled to a first designated depth. The first string of casing is hung from the surface, and then cement is circulated into the annulus behind the casing. The well is then drilled to a second designated depth, and a second string of casing, or liner, is run into the well. The second string is set at a depth such that the upper portion of the second string of casing overlaps the lower portion of the first string of casing. The second liner string is then fixed or "hung" off of the existing casing by the use of slips, which utilize slip members and cones to fix the new string of liner in the wellbore. The second casing string is then cemented. This process is typically repeated with additional casing strings until the well has been drilled to total depth. In this manner, wells are typically formed with two or more strings of casing of an ever decreasing diameter.

Apparatus and methods are emerging that permit tubulars such as casing strings to be expanded in situ. The apparatus typically includes expander tools which are fluid powered and are run into the wellbore on a working string. The hydraulic expander tools include expandable members which, through fluid pressure, are urged outward radially from the body of the expander tool and into contact with a tubular therearound. As sufficient pressure is generated on a piston surface behind these expansion members, the tubular being acted upon by the expansion tool is expanded past its point of elastic deformation. In this manner, the inner and outer diameter of the tubular is increased in the wellbore. By rotating the expander tool in the wellbore and/or moving the expander tool axially in the wellbore with the expansion member actuated, a tubular can be expanded into plastic deformation along a predetermined length in a wellbore.

Multiple uses for expandable tubulars are being developed. For example, an intermediate string of casing can be hung off of a string of surface casing by expanding an upper portion of the intermediate string into frictional contact with the lower portion of surface casing therearound. This allows for the hanging of a string of casing without the need for a separate slip assembly as described above. Additional applications for the expansion of downhole tubulars exist. These include the use of an expandable sand screen, employment of an expandable seat for seating a diverter tool, and the use of an expandable seat for setting a packer.

Various types of expander tools are being developed. The most basic type employs a simple cone-shaped body which is run into a wellbore, and then mechanically actuated to expand outwardly. The expander tool is then pulled upward in the wellbore by pulling the working string from the surface. A basic arrangement of a conical expander tool is disclosed in U.S. Pat. No. 5,348,095, issued to Worrall, et al., in 1994 and that patent is incorporated herein in its entirety. Pulling the expanded conical tool has the effect of expanding a portion of a tubular into sealed engagement with a surrounding formation wall, thereby sealing off the annular region therebetween.

More recently, rotary expander tools have been developed. Rotary expander tools employ one or more rows of compliant rollers which are urged outwardly from a body of the expander tool in order to engage and to expand the surrounding tubular. The expander tool is rotated downhole so that the actuated rollers can act against the inner surface of the tubular to be expanded in order to expand the tubular body circumferentially. Radial expander tools are described in U.S. Pat. No. 6,457,532 and that patent is incorporated herein by reference in its entirety.

There are problems associated with the expansion of tubulars. One problem particularly associated with the use of rotary expander tools is the likelihood of obtaining an uneven expansion of a tubular. In this respect, the inner diameter of the tubular that is expanded tends to initially assume the shape of the compliant rollers of the expander tool, including imperfections in the rollers. Moreover, as the working string is rotated from the surface, the expander tool may temporarily stick during expansion of a tubular, then turn quickly, and then stop again. This spring-type action in the working string creates imperfections and, possibly, gaps in the expansion job.

Another obstacle to smooth expansion relates to the phenomenon of pipe stretch. Those of ordinary skill in the art will understand that raising a working string a selected distance at the surface does not necessarily result in the raising of a tool at the lower end of a working string by that same selected distance. The potential for pipe stretch is great during the process of expanding a tubular. Once the expander tool is actuated at a selected depth, an expanded profile is created within the expanded tubular. This profile creates an immediate obstacle to the raising or lowering of the expander tool. Merely raising the working string a few feet from the surface will not, in many instances, result in the raising of the expander tool; rather, it will only result in stretching of the working string. Applying further tensile force in order to unstick the expander tool may cause a sudden recoil, causing the expander tool to move uphole too quickly, again leaving gaps in the tubular to be expanded.

The same problem exists in the context of pipe compression. In this respect, the lowering of the working string from the surface does not typically result in a reciprocal lowering of the expander tool at the bottom of the hole. This problem is exacerbated by rotational sticking, as discussed above. The overall result of these sticking problems is that the inner diameter of the expanded tubular may not have a uniform inner circumference.

In still other cases, an expander tool can displace material as it travels along the interior of a tubing, forming a "wave" of material that can grow longer and ultimately jam the extendable member of the tool.

Further, expansion apparatus are frequently used to expand a smaller tubular into frictional engagement with larger tubulars therearound. Because there are no real indicators of the relative positions of the tubulars, an operator at the surface can never be completely sure that there is frictional contact between the tubulars.

There is a need, therefore, for an improved apparatus for expanding a portion of casing or other tubular within a wellbore. Further, there is a need for an apparatus which will provide information to the operator at the surface as to the location of the expander tool downhole. Correspondingly, there is a need for an improved expander tool which informs the operator at the surface as to the depth of the expander tool, and the extent of tubular expansion at that particular depth during the expansion process.

SUMMARY OF THE INVENTION

The present invention provides an improved expander tool for expanding a tubular body in a wellbore. According to the present invention, an expander tool is provided which includes one or more sensing devices. In operation, the expander tool is run into the wellbore on a working string, along with the sensing devices. The sensors provide information to the operator at the surface, such as the depth of the expander tool and a variety of other downhole variables.

In one embodiment, the expander tool includes a sensor for sensing the wall thickness of the expandable tubular during expansion. Thickness readings are transmitted to the operator at the surface. Once the tubular wall has been expanded to a desired amount as reflected in the wall thickness measurements, the expander tool can be translated vertically to produce a continuous, expanded length of tubular. After the tubular has been expanded along a desired length, pressure actuation of the hydraulic expander tool is relieved and the tool is removed from the wellbore.

The expander tool may also include, in one arrangement, a central processing unit for controlling the transmission of data from a sensor to the surface. The expander tool may further optionally include a recording device electronically connected to the sensor. The recording device can be retrieved from the wellbore along with the expander tool after the expansion operation is completed. Data from the recording device can then be downloaded and reviewed by the operator. The recording device provides visual confirmation to the operator and to the customer that the expansion job has been completed satisfactorily.

In yet another aspect of the expander tool of the present invention, a data transmission device is provided. The data transmission device transmits data from the sensors downhole to a server at the surface. Examples of data transmission devices include an electrical line, a fluid pulse telemetry system, and a low frequency electromagnetic wave system. In this way, the operator at the surface can monitor progress of the expansion operation downhole in real time.

BRIEF DESCRIPTION OF THE DRAWINGS

So that the manner in which the above recited features of the present invention are attained and can be understood in detail, a more particular description of the invention, briefly summarized above, may be had by reference to the appended drawings. It is to be noted, however, that the appended drawings illustrate only typical embodiments of this invention and are therefore not to be considered limiting of its scope, for the invention may admit to other equally effective embodiments.

FIG. 2 is an exploded view of an expander tool of the present invention.

FIG. 3 is a cross-sectional view of the expander tool of FIG. 2, taken across line 3-3 of FIG. 2.

FIG. 5 is a schematic representation of the sensing components of the expander tool of the present invention.

DETAILED DESCRIPTION OF THE PREFERRED EMBODIMENT

Figure 1:
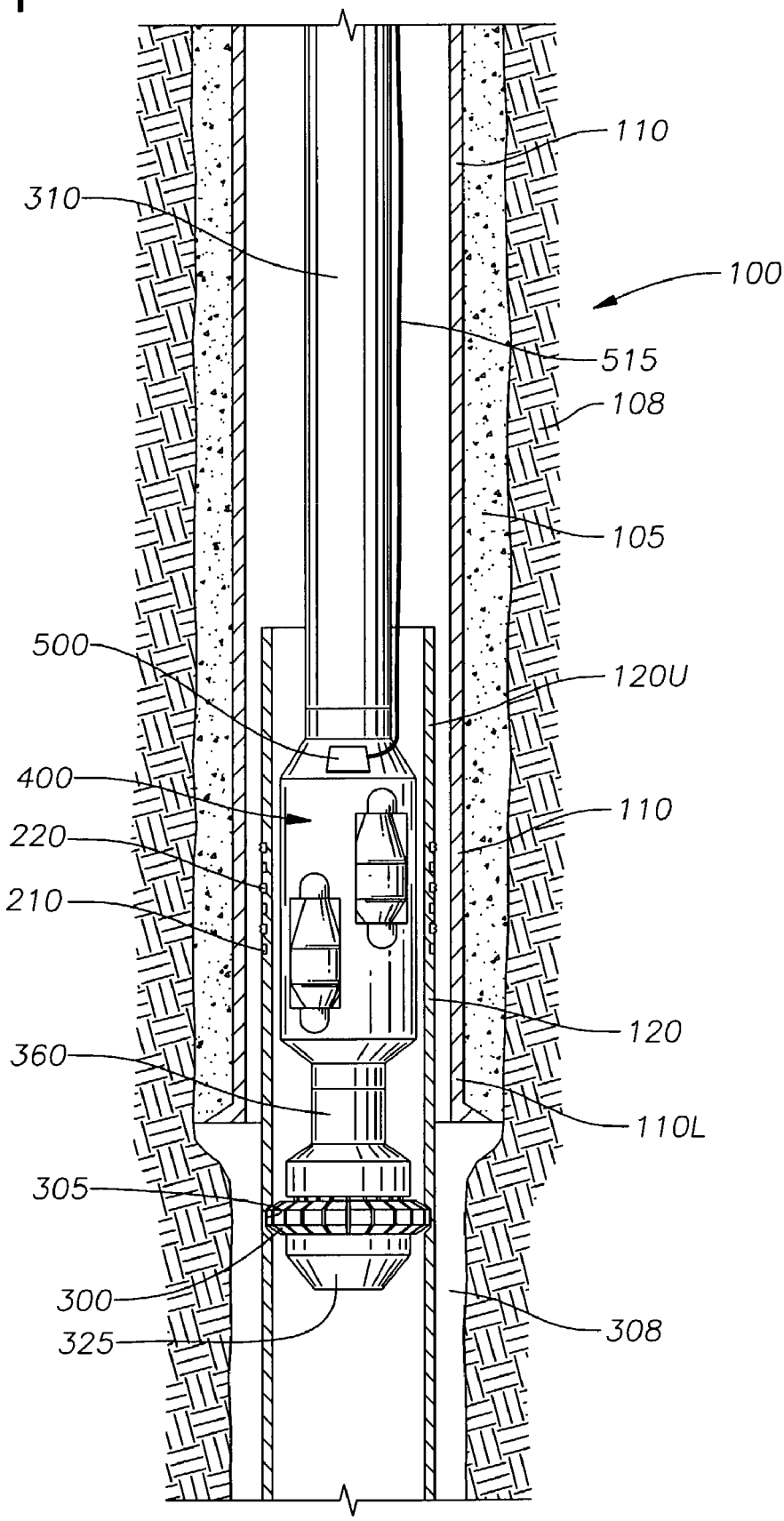
FIG. 1 is a cross-sectional view of a wellbore having an upper string of casing, and a lower string of casing being lowered into the upper string of casing. In this view, the lower string of casing serves as the expandable tubular. Also depicted in FIG. 1 is an expander tool of the present invention for expanding the lower string of casing.

FIG. 1 presents a cross-sectional view of a wellbore 100 having an upper string of casing 110 and a lower string of casing 120. The lower string of casing 120 is being lowered into the wellbore 100 co-axially with the upper string of casing 110 by means of a working string 310. The lower string of casing 120 is positioned such that an upper portion 120U thereof overlaps with a lower portion 110L of the upper string of casing 110.

An upper annulus 105 is seen between the upper string of casing 110 and the wellbore formation 108. Likewise, a lower annulus 308 is seen between the lower string of casing 120 and the wellbore formation 108. Cement is depicted in the annular area 105 outside of the upper string of casing 110, demonstrating that the upper string of casing 110 has been cemented in place. However, the annular area 308 between the lower string of casing 120 and the formation 108 has not yet been cemented in place.

In the arrangement of FIG. 1, the lower string of casing 120 serves as an expandable tubular. The lower string of casing 120 will be expanded into the upper string of casing 110 by using an expander tool 400 of the present invention. By expanding the upper portion 120U of the lower string of casing 120 into the upper casing string 110, the lower string of casing 120 will be effectively hung in the wellbore 100. In this respect, the lower string of casing 120 is expanded into frictional engagement with the upper string of casing 110. While FIG. 1 presents a lower string of casing 120 as an expandable tubular, it is understood that the expander tool 400 of the present invention may be utilized to expand downhole tubulars other than strings of casing.

Figure 4:
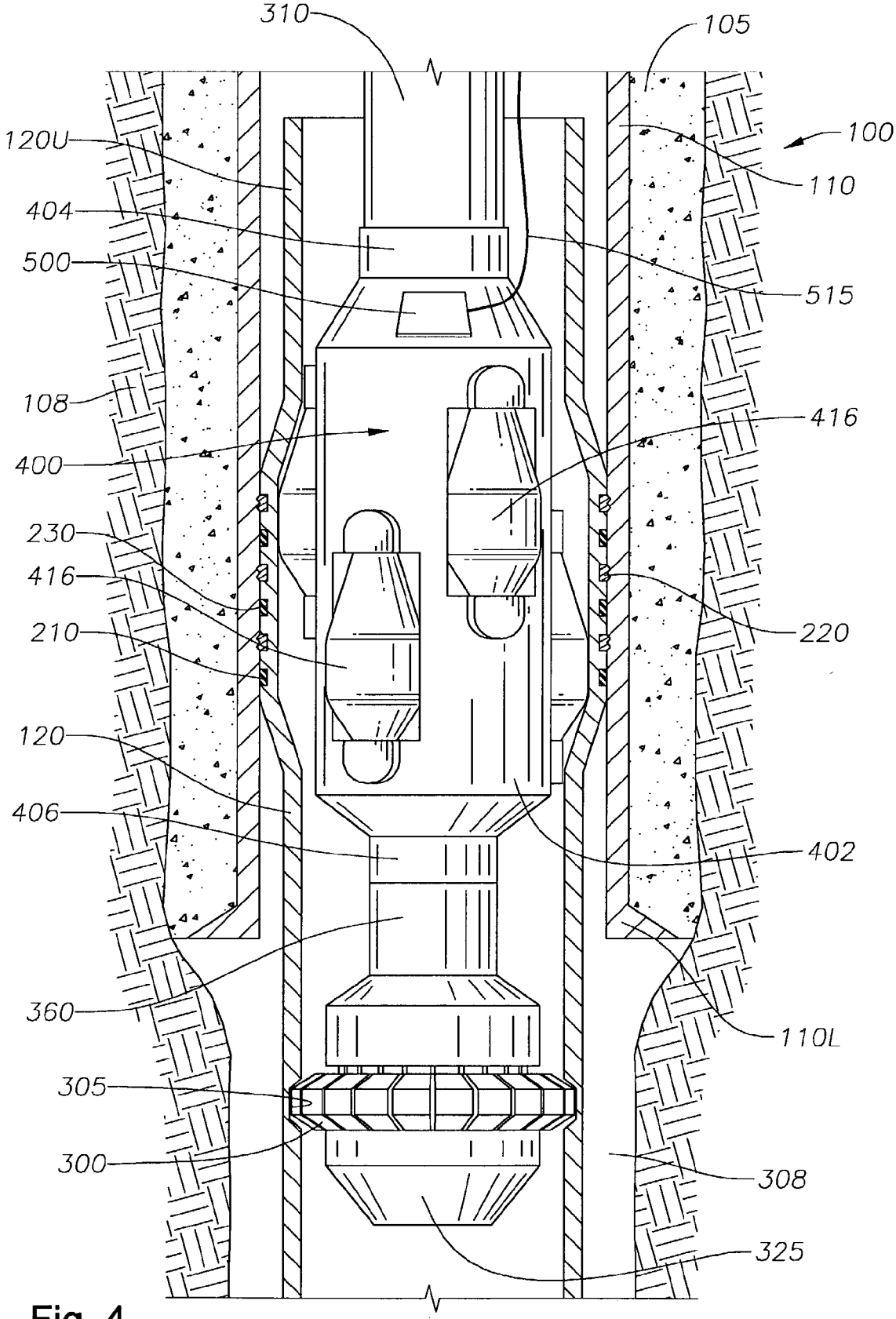
FIG. 4 is an enlarged view of the wellbore of FIG. 1. In this view, the expander tool has been actuated so as to begin expanding the lower string of casing.

A sealing member 210 is optionally disposed on the outer surface of the lower string of casing 120. The sealing member 210 serves to provide a fluid seal between the outer surface of the lower string of casing 120U and the inner surface of the upper string of casing 110L after the lower casing string 120U has been expanded. The sealing member 210 may define one or more simple rings formed circumferentially around the lower string of casing 120U. However, it is preferred that the sealing member 210 define a deformable material lodged within a matrix of grooves 230. FIG. 4 presents an enlarged view of the wellbore 100 of FIG. 1. In this view, the sealing member 210 can be seen at various points along the outer surface of casing string 120, consistent with a matrix-type configuration. It is understood, however, that other configurations are permissible and that the sealing member 210 itself is optional.

The sealing member 210 is fabricated from a suitable material based upon the service environment that exists within the wellbore 100. Factors to be considered when selecting a suitable sealing member 210 include the chemicals likely to contact the sealing member, the prolonged impact of hydrocarbon contact on the sealing member, the presence and concentration of erosive compounds such as hydrogen sulfide or chlorine, and the pressure and temperature at which the sealing member must operate. An elastomeric material is most commonly preferred for the sealing member 210; however, non-elastomeric materials or polymers may be employed as well, so long as they substantially prevent production fluids from passing upwardly between the outer surface of the lower string of casing 120U and the inner surface of the upper string of casing 110L after the expandable section 120U of the casing 120 has been expanded.

Also seen on the outer surface of the lower string of casing 120 in FIG. 4 is at least one slip member 220. The slip member 220 is used to provide an improved grip between the expandable tubular 120U and the upper string of casing 110L when the lower string of casing 120U is expanded. The slip member 220 may define a simple ring having grip surfaces formed thereon for engaging the inner surface of the upper string of casing 110 when the lower string of casing 120 is expanded. However, numerous other slip arrangements may be employed, such as a plurality of carbide buttons 220 interspersed within the matrix 230 of sealing member 210, as shown in FIG. 4. It is understood that any suitable placement of a hardened material which provides a gripping means for the lower string of casing 120 into the upper string of casing 110 is acceptable for the gripping means 220. The size, shape and hardness of the slips 220 are selected depending upon factors such as the hardness of the inner wall of casing 110, the weight of casing string 120 being hung, and the arrangement of slips 220 used.

The lower string of casing 120 is supported on the working string 310 by a releasable carrying mechanism 300. The carrying mechanism 300 may be a threaded connection, a fluid actuated connection, or other known carrying device. In the embodiment of FIG. 1, an expandable collet is used as the carrying mechanism 300. The collet 300 is landed into a radial profile 305 within the lower string of casing 120 so as to temporarily support the lower string of casing 120. The collet 300 is hydraulically or mechanically actuated as is known in the art, and supports the lower string of casing 120 until such time as the lower string of casing 120 has been initially expanded.

In order to expand the lower string of casing 120, an expander tool 400 is provided. An exemplary expander tool 400 is shown in side view in FIG. 1. The expander tool 400 is seen more fully in an exploded view in FIG. 2. FIG. 3 presents a portion of the same expander tool 400 in cross-section, with the view taken across line 3-3 of FIG. 1.

The expander tool 400 has a central body 402 which is hollow and generally tubular. Connectors 404 and 406 are provided at opposite ends of the body 402 for connection to other downhole components. The upper connector 404 is shown in FIG. 1 as being connected to the working string 310. The lower connector 406 is shown connected to a swivel 360. The connectors 404 and 406 are of a reduced diameter (compared to the outside diameter of the body 402 of the tool 400).

The central body 402 allows the passage of fluids through a hollow fluid passageway 415 of the expander tool 400, and through the connectors 404 and 406. The central body 402 has a plurality of recesses 414 to hold a respective roller 416. Each of the recesses 414 has parallel sides and holds a roller 416 capable of extending radially from the radially perforated fluid passageway 415.

In one embodiment of the expander tool 400, rollers 416 are near-cylindrical and slightly barreled. Each of the rollers 416 is supported by a shaft 418 at each end of the respective roller 416 for rotation about a respective rotational axis. The rollers 416 are generally parallel to the longitudinal axis of the tool 400. The plurality of rollers 416 are radially offset at mutual circumferential separations around the central body 402. In the arrangement shown in FIG. 2, two rows of rollers 416 are employed. However, it is understood that any number of rows of rollers 416 may be incorporated into the body 402.

While the rollers 416 illustrated in FIG. 2 have generally barrel-shaped cross sections, it is to be appreciated that other roller shapes are possible. For example, a roller 416 may have a shape that is cylindrical, conical, truncated conical, semi-spherical, multifaceted, elliptical or any other cross sectional shape suited to the expansion operation to be conducted within the tubular 400. In addition, the roller 416 may rest in a cradle (not shown) around the tool body 402 so that the roller 416 partially rolls and partially skids as it expands the surrounding tubular, e.g., tubular 120U. Alternatively, a roller body might be supplied that is fixed relative to the roller body, but having a plurality of bearings that live in races. A variety of other roller body arrangements may be employed. It is understood that the expander tool of the present invention is not limited by the arrangement of the roller body 416 or other portion of the expander tool 400 itself.

Referring again to FIG. 2, each roller 416 is shown to ride around a shaft 418. Each shaft 418 is formed integral to its corresponding roller 416 and is capable of rotating within a corresponding piston 420. The pistons 420 are radially slidable, one piston 420 being slidably and sealingly received within each radially extended recess 414. The back side of each piston 420 is exposed to the pressure of fluid within the bore 415 of the tool 400 by way of the tubular 310. In this manner, pressurized fluid provided from the surface of the well can actuate the pistons 420 and cause them to extend outwardly whereby the rollers 416 contact the inner surface of the tubular 120 to be expanded. A stop member (not shown), may optionally be added to prohibit the pistons 420 from overly extending out of their respective recesses 414.

The expander tool 400 is preferably designed for use at or near the end of the working string 310. In order to actuate the expander tool 400, fluid is injected into the working string 310. Fluid under pressure then travels downhole through the working string 310 and into the perforated tubular bore 415 of the tool 400. From there, fluid contacts the backs of the pistons 420. As hydraulic pressure is increased, fluid forces the pistons 420 from their respective recesses 414. This, in turn, causes the rollers 416 to make contact with the inner surface of the liner 400. Fluid finally exits the expander tool 400 through connector 406 at the base of the tool 400.

The circulation of fluids to and within the expander tool 400 may optionally be regulated so that the contact between and the force applied to the inner wall of liner 120 is controlled. The pressurized fluid causes the roller assembly 416 to extend radially outward and into contact with the inner surface of the lower string of casing 120. With a predetermined amount of fluid pressure acting on the piston surface 420, the lower string of casing 120 is expanded past its elastic limits.

A fluid outlet 325 is provided at the lower end of the working string 310. The fluid outlet 325 may serve as a fluid conduit for cement to be circulated into the wellbore 100 so that the lower string of casing 120 can be cemented into the wellbore 100 during the well completion process. FIG. 1 demonstrates that cement has not yet been placed into the annulus 308 of the lower string of casing 120.

As noted, the lower connector 406 is connected to a downhole swivel 360. The swivel 360 allows the expander tool 400 to rotate within the wellbore 100 without upsetting the connection between the expandable tubular 120 and the working string 310. The expander tool 400 rotates within the wellbore 100 in order to rotate the actuated rollers 416, thereby radially expanding the lower string of casing 120 or other expandable tubular at the desired depth in the wellbore 100. The swivel 360 allows the body 402 of the expander tool 400 to be rotated by the working tubular 310 while the releasable connection 300 remains stationary. The swivel 360 is shown schematically in FIG. 1 as a separate downhole tool. However, the swivel 360 may alternatively be incorporated into the expander tool 400 by use of a bearing-type connection (not shown).

The expander tool 400 of the present invention may be of any type or configuration. In this respect, it is again noted that the expander tool 400 depicted in FIGS. 1-3 are merely exemplary. However, it is preferred that a rotary expander tool be used. This means that the desired expansion is accomplished by rotating expanded rollers 416 against the inner surface of the expandable tubular 120U. Preferably, rotation of the expander tool 400 is imparted by rotating the working string 310. However, rotation may also be imparted by a downhole mud-type motor (not shown).

FIG. 4 depicts the wellbore of FIG. 1. In this view, the expander tool 400 has been actuated so as to begin expanding the upper portion 120U of the lower string of casing 120. It can be seen in this view that portions of the sealing member 210 have begun engaging the inner surface of the upper casing string 110L. Likewise, the slips 220 have begun biting into the inner surface of the upper casing string 110L to provide greater frictional engagement.

In order to monitor the progress of the expander tool 400 during the expansion process, the expander tool 400 of the present invention incorporates one or more sensing features. In FIG. 4 it can be seen that a first sensor 500 is positioned on the body 402 of the expander tool 400.

FIG. 5 is a schematic representation of the components of the expander tool 400 of the present invention. The components include at least one sensor 500 proximal to the central body 402 of the expander tool 400. In the arrangement of FIG. 5, two separate sensors 500 and 500' are employed. The sensors 500, 500' are preferably positioned on the top of the body 402 of the expander tool 400. However, it is understood that the sensors 500, 500' may be incorporated elsewhere within the expander tool 400. Alternatively, the sensors 500, 500' may optionally be placed on a sub (not shown) immediately above or below the expander tool 400.

One type of sensing device 500 which might be used in the expander tool 400 of the present invention is a device for sensing the wall dimensions of the expandable tubular 120U. An example of such a dimensions sensor is a caliper log. Caliper logs have known utility in connection with casing inspections. A caliper log operates to detect the inner diameter of a string of pipe, and is able to detect even small irregularities therein. Caliper logs are commonly used to detect perforations or wear in a string of casing. As used in the present invention, the caliper log is run into the hole proximate to the expander body 402. The caliper log employs a number of feelers (not shown) on various sizes of calipers in order to detect the diameter of the casing wall. The wall at issue in the present application would be the inner diameter of the upper portion 120U of the lower string of casing 120. In this way, the caliper log can detect when the inner diameter of the lower string of casing 120 has been adequately expanded.

Another example of a sensor 500 for sensing the progress of expansion is a sonic log. Sonic logs are typically utilized to determine the density or porosity of a surrounding formation downhole. However, a sonic log may also be employed to determine the thickness of a surrounding steel casing. In the context of tubular expansion, a sonic log will detect an increase in wall thickness which occurs when the expandable tubular is expanded into contact with the surrounding second tubular.

A sonic log utilizes a transmitter (not shown) which emits a pulse of energy at a designated frequency and cycle. Two or more receivers are positioned to receive the pulses. The spacing of the receivers depends upon the sonde design. The time differential between when the acoustic wave train reaches the first receiver and the second receiver defines the log. The log readout will vary depending upon the thickness of the surrounding casing. Thus, the sonic log is able to detect when the lower string of casing 120U has been expanded into contact with the upper string 110.

The sonic log defines any acoustic-type log for measuring density. Such would encompass a density log and an ultrasonic log. The sonic log may be utilized in conjunction with, or in lieu of, the caliper log.

Another example of a sensor for sensing the progress of expansion is an electromagnetic thickness tool. Electromagnetic thickness tools typically consist of a transmitter coil (not shown) and a receiver coil (not shown). An alternating current is sent through the transmitter coil. This creates an alternating magnetic field which interacts both with the surrounding casing 110, 120U and the receiver coil. The signal induced in the receiver coil will be out of phase with the transmitted signal. In general the phase difference is controlled by the thickness of the casing wall. Thus, the raw log measurement is one of phase lag. In the context of tubular expansion, an electromagnetic thickness tool will detect an increase in wall thickness which occurs when the expandable tubular is expanded into contact with the surrounding second tubular.

The electromagnetic thickness tool may be utilized in conjunction with, or in lieu of, the caliper log or the sonic log. It is within the scope of the present invention to utilize any known means for sensing the thickness of the casing wall or otherwise detecting expansion of the upper portion 120U of the lower string of casing 120 into the upper string of casing 110.

The details of a sensing log, such as a caliper log, a sonic log, or an electromagnetic thickness tool are not depicted in FIG. 5. Rather, it is to be understood that sensors 500 and 500' schematically represent sensors such as the above logs. The use of such logging instruments in other contexts is known by those of ordinary skill in the art.

One of the sensors, e.g., 500', may be a pressure gauge. The pressure gauge would be disposed in or at least proximate to the bore 415 of the expander tool 400 in order to measure fluid pressure therein. Alternatively, or in addition, sensor 500' could be a pressure differential gauge for measuring the difference in internal and external fluid pressure of the body 402 of the expander tool 400. A pressure sensor located adjacent the expansion tool is useful for measuring the pressure of fluid used to actuate the slidable pistons of the expander tool.

In another variation, the sensors used with the expander tool are proximity sensors that measure the position of the fluid actuated pistons in relation to the body of the expander tool. In this manner, the distance of the actuated roller from the body can be calculated, and the relative distance of the tubular wall from the body can also be calculated.

In response to the problem created as material is displaced at the leading edge of the expander tool, a sensor could be placed in a position just in front of the tool in order to measure the material that is gathering at that location. For example, using sonic or magnetic sensors that are known in the art, the amount and/or dimension of the material could be gauged and the operation of the expander tool adjusted accordingly.

In yet another embodiment, contact between an expanded tubular and the wellbore therearound could be monitored with a sensor using a sonic or acoustic-type tool to produce sounds emanating from the area of expansion. The sensor that receives the sound then differentiates a sound produced by a tubular in contact with a wellbore, cement, or another tubular therearound from a sound produced by the same tubular not in contact with the wellbore, cement, or another tubular.

A means is needed in order to provide power to the sensors 500, 500'. The use of any power supply arrangement is within the scope and spirit of the present invention. Examples include downhole batteries, an electrical line run in on jointed or coiled tubing, or a downhole turbine which generates electricity in response to the circulation of drilling mud. Another example is the use of pipe as the working string which includes specially embedded wires or other conductive materials for placing downhole tools in electrical communication with a power source at the surface.

In one arrangement of the present invention, it is necessary to transmit measurements taken by the sensors, such as sensor 500, to the operator at the surface. The operator monitors data generated by the sensors 500 in real time. When the operator determines that sufficient expansion has occurred at a particular depth, the operator translates the expander tool 400 axially within the wellbore 100. This would typically occur by raising and/or lowering the drill string 310 from the surface. However, means are being developed for controllably translating the expander tool 400 through a downhole translation device (not shown). It is understood that the present invention is not limited by the means in which the expander tool is translated in the wellbore.

The transmission of data generated downhole may be accomplished in various ways. In its simplest embodiment, a free electrical wire is connected to a server 520 at the surface. A free electrical wire 515 is depicted schematically in FIG. 5.

Numerous other techniques exist for transmitting data from downhole to an operator at the surface. One example is the use of a system for transmitting low frequency electromagnetic waves through the earth to a receiver at the surface. Alternatively, measured data values may be communicated using "fluid pulse telemetry" (FPT), also called "mud pulse telemetry" (MPT). FPT, such as described in U.S. Pat. No. 4,535,429, requires that the well fluid be circulated to transmit data to the well surface. This arrangement is oftentimes used in connection with measurement-while-drilling, or "MWD."

Yet another alternative is the use of so called "smart pipe." This is a working string having a conductive medium embedded in the steel wall capable of transmitting data through the pipe structure itself. In one arrangement, the smart pipe may have wires embedded within the steel walls and which are in electrical communication along the length of the pipe system. In another arrangement, the metal composition of the pipe itself may permit electrical communication along its length. In still a further system of data transmission, a wireless digital communication system may be employed. Again, however, it is within the scope of the present invention to employ any means for transmitting downhole data to the surface.

Figure 6:
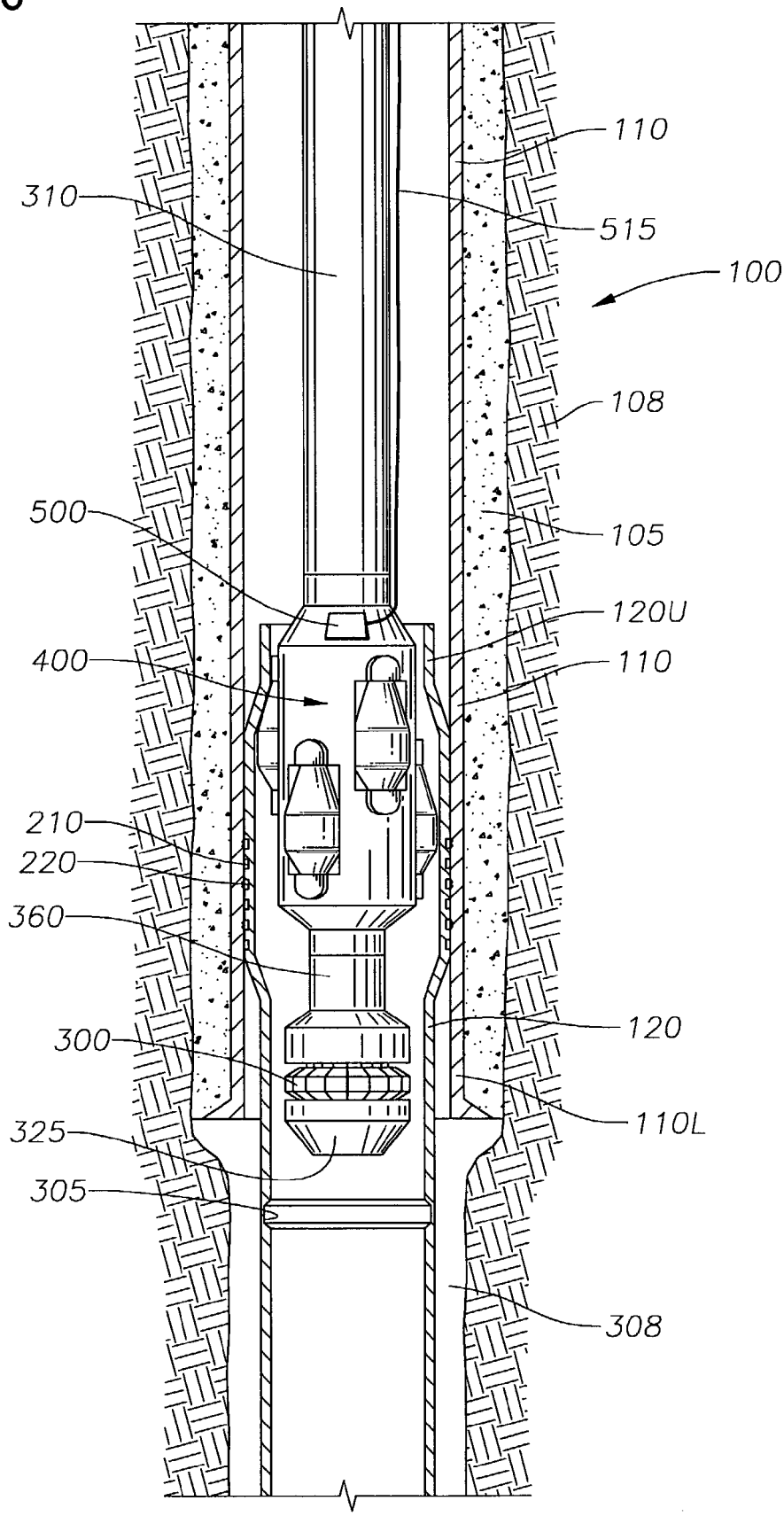
FIG. 6 depicts the wellbore of FIG. 5. In this view, the expander tool remains actuated. The temporary mechanical connection between the working string and the liner has been de-actuated to permit vertical movement of the working string. The expander tool is being raised within the wellbore so as to expand the lower string of casing along a desired length.

FIG. 6 presents an expander tool 400 of the present invention within the wellbore 100 of FIG. 5. In this view, the expander tool 400 has been actuated. As explained above, actuation of the expander tool 400 is by injection of fluid under pressure into the working string 310. Fluid travels from the surface, down the working string 310, and through the bore 415 of the expander tool 400. Hydraulic pressure forces the rollers 416 outward against the inner surface of the expandable tubular 120U. It can be seen in FIG. 6 that an initial portion of the lower string of casing 120U has been expanded. At this point, the expander tool 400 has not yet been raised within the wellbore 100. The collet 300 remains connected to the lower string of casing 120 to maintain the lower string of casing 120 in position until initial expansion of the lower casing string 120 is accomplished. Once the lower casing string 120U has been circumferentially expanded at the initial depth, the collet 300 may be released from its temporary connection with the lower string of casing 120. The expander tool 400 can then be raised or lowered in order to expand a portion 120U of the lower string of casing 120 into frictional engagement with the overlapping portion 110L of the upper string of casing 110. Translation of the expander tool 400 within the wellbore 100 is in response to downhole data indicating sufficient initial expansion of the lower string of casing 120U.

Figure 7:
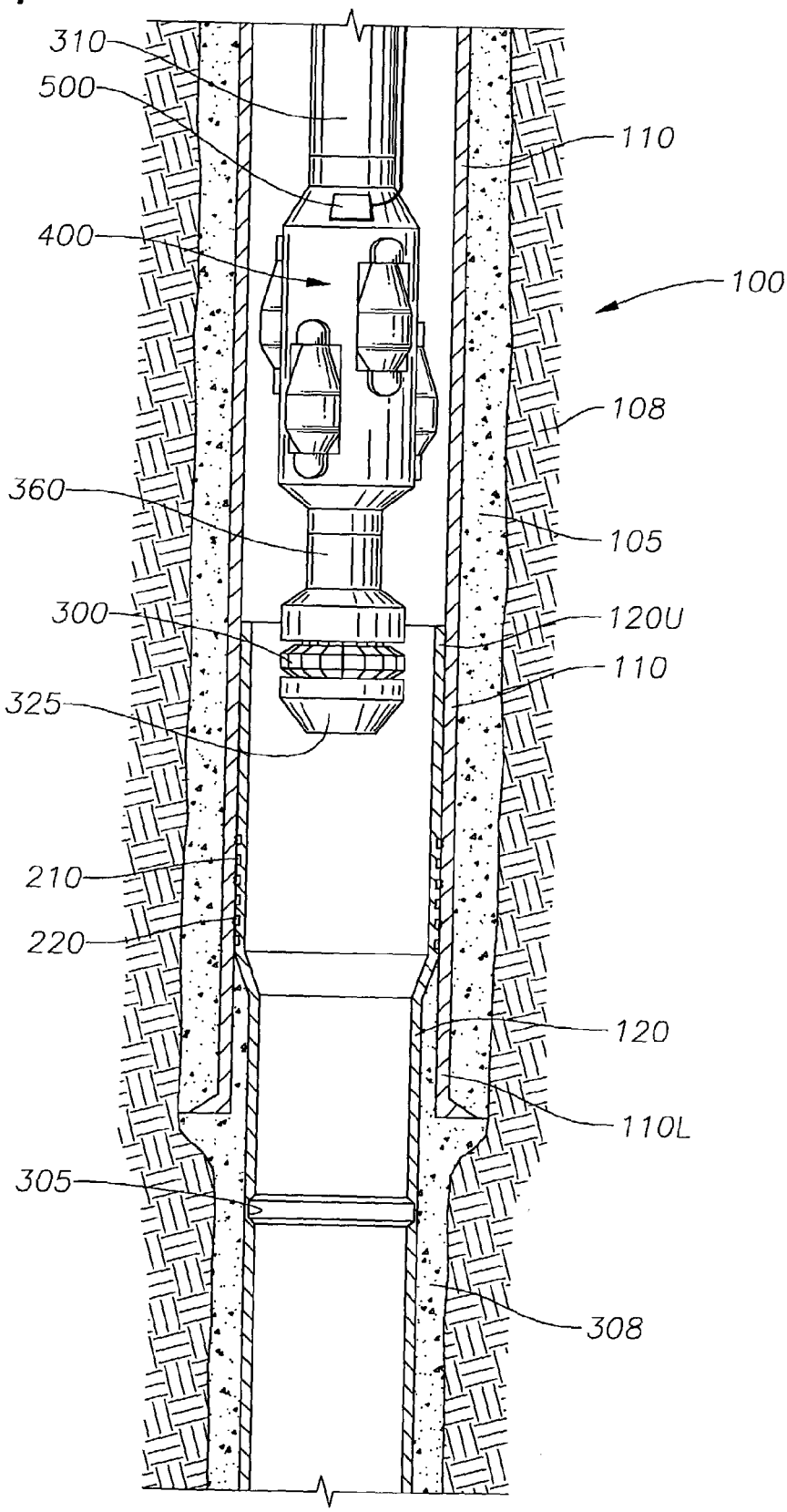
FIG. 7 depicts the wellbore of FIG. 6. In this view, the expander tool is being removed from the wellbore. The lower string of casing has been expanded into the upper string of casing along a desired length within the wellbore.

FIG. 7 depicts the wellbore 100 of FIG. 6. In this view, the expander tool 400 is being removed from the wellbore 100. The lower string of casing 120U has been expanded into the upper string of casing 110 along a desired length within the wellbore 100. The collet 300 has been detached from the lower string of casing 120 to allow removal of the expander tool 400 within the wellbore 100. In accordance with the present invention, the sensors 500, 500' in the expander tool 400 have provided confirmation to the operator of sufficient expansion of the expandable tubular 120U along the desired length.

In one aspect of the present invention, the expansion process is automated. To accomplish this, a central processing unit (CPU) is first employed. The CPU may be a part of the server 520 at the surface. Alternatively, or in addition, the CPU 510 may be positioned downhole with the sensor 500. A downhole CPU 510 is depicted schematically in FIG. 5.

As shown in FIG. 5, the CPU 510 is in electrical communication with the sensors, e.g., sensor 500. Electrical connection is shown schematically by line 525. The CPU 510 may be any of a variety of suitable computer controllers or application specific integrated circuits (ASIC). CPU 510 contains electronic circuitry and/or embedded controls to provide a time circuit so as to actuate the sensors, e.g., sensor 500. The CPU 510 may optionally further record data generated by the sensors 500, 500' so as to provide recorded confirmation to the customer that an appropriate expansion operation has been conducted. Finally, the CPU 510 may be in electrical communication with a translation apparatus (not shown) which translates the expander tool 400 downhole without manipulation of the drill string 310 from the surface. When the CPU 510 reads data from the sensors, e.g., sensor 500, indicating that complete tubular expansion has taken place at a particular depth, the CPU 510 will incrementally actuate the downhole translation apparatus in order to move the actuated expander tool 400 to a new depth.

A power supply (not shown) may be provided with CPU 510 to provide adequate electrical power (e.g., a suitably sized battery) needed in the operation of CPU 510. The CPU 510 may also include a timing circuit that may be activated in coordination with surface pumping operations so that measurements recorded by recorder 530 may be more readily compared with surface instrument measurements. The central processing unit 510 controls the transmission and recording of data from the at least one sensor 500. In one automated arrangement for the expander tool 400 of the present invention, the CPU 510 transmits signals to a downhole translation apparatus (not shown) causing the expander tool 400 to be translated from downhole without raising or lowering the drill string 310 from the surface. Such signals would be transmitted when the sensor 500 confirms engagement of the expandable tubular 120U with the inner surface of the lower string of casing 110L. For example, a signal could be sent causing the downhole translation apparatus to operate for a period of time necessary to translate the expander tool 400 upward by a length of 4 inches. This cycle would be repeated for a preset number of times which is dependent upon the desired length of tubular expansion.

After the lower casing string 120 has been expanded into frictional contact with the inner wall of the upper casing string 110L, the expander tool 400 is deactivated. In this regard, fluid pressure supplied to the pistons 420 is reduced or released, allowing the pistons 420 to return to the recesses 414 within the central body 402 of the tool 400. The expander tool 400 can then be withdrawn from the wellbore 100 by pulling the run-in tubular 310. The expander tool 400 is then removed.

Figure 8:
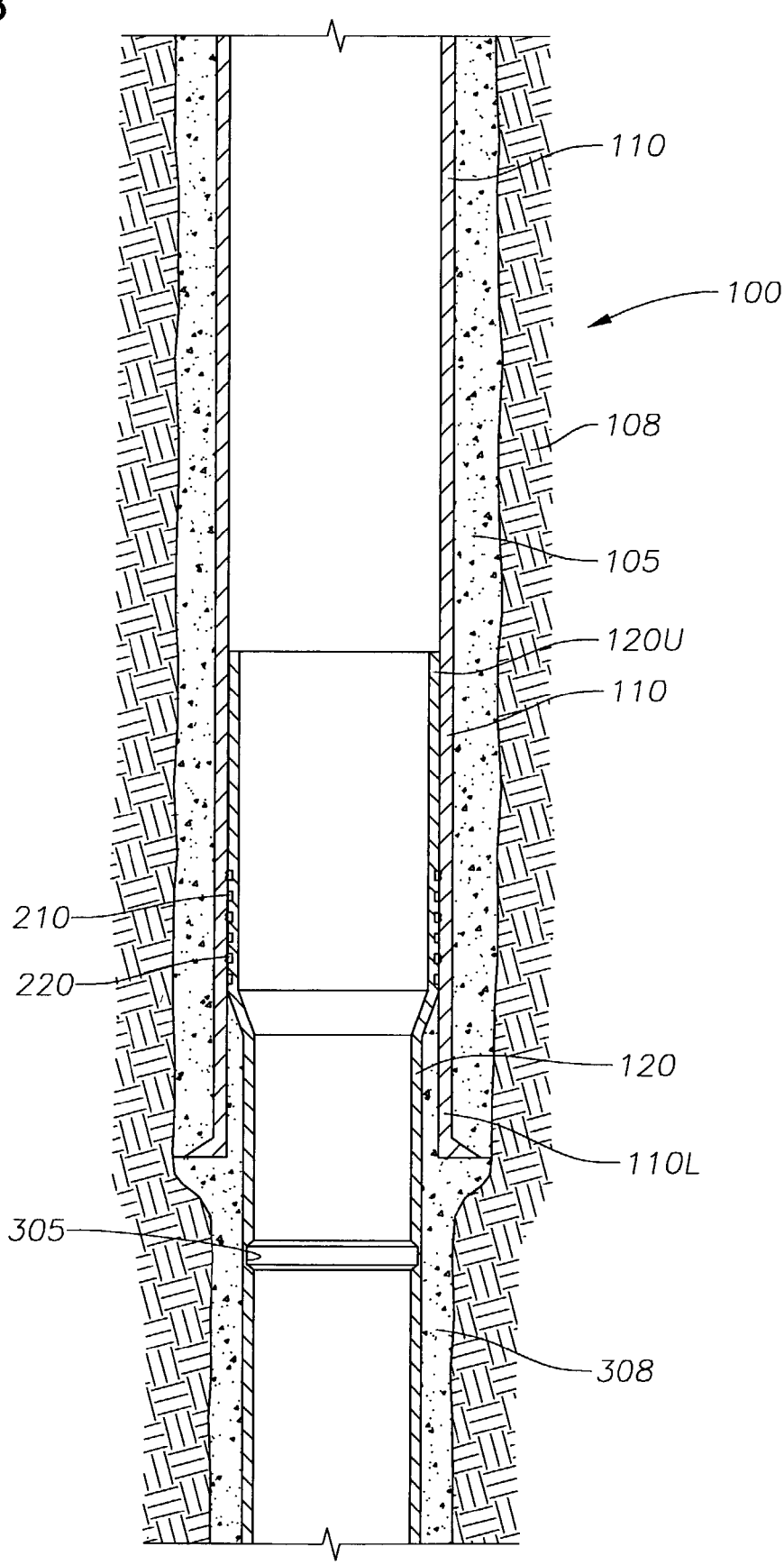
FIG. 8 depicts the wellbore of FIG. 6. Here, the working string has been pulled from the wellbore. The expander tool has been removed from the wellbore along with the working string, leaving the lower string of casing expanded into frictional and sealing engagement with the surrounding upper string of casing.

FIG. 8 depicts the wellbore of FIG. 7. Here, the working string 310 has been pulled from the wellbore 100. The expander tool 400 has been removed from the wellbore 100 along with the working string 310, leaving the lower string of casing 120 expanded into frictional and sealing engagement with the surrounding upper casing string 110L. The seal member 210 and the slip member 220 are engaged to the inner surface of the upper string of casing 110L. Further, the annulus 308 between the lower string of casing 120 and the formation 108 has been filled with cement, excepting that portion of the annulus 308 which has been removed by expansion of the lower string of casing 120L.

While the foregoing is directed to embodiments of the present invention, other and further embodiments of the invention may be devised without departing from the basic scope thereof, and the scope thereof is determined by the claims that follow.

The invention claimed is:

1. A method of utilizing an expander tool in conjunction with a sensor on a tubular string in a wellbore, comprising:

running the expander tool to a predetermined depth in the wellbore;

activating the expander tool and urging an expansion unit outward in order to expand a tubular therearound past an elastic limit of the tubular; and operating the sensor to derive information relative to a fluid pressure difference between an internal pressure within the expander tool and an external fluid pressure during expansion of the tubular in the wellbore proximate the expander tool.

2. A method of utilizing an expander tool in conjunction with a sensor on a tubular string in a wellbore, comprising:

running the expander tool to a predetermined depth in the wellbore;

activating the expander tool in order to expand a tubular therearound past an elastic limit of the tubular; and operating the sensor to derive information relative to a wall thickness of the tubular prior to expansion of the tubular in the wellbore proximate the expander tool.

3. The method of claim 2, further comprising operating the sensor to derive information relative to the wall thickness of the tubular after expansion of the tubular.

4. The method of claim 2, wherein the tubular strina or the expander tool comprises a sonic log sensor for sensing whether the tubular is contacting the wellbore, cement, or another tubular during expansion of the tubular.

5. The method of claim 2, wherein the tubular string or the expander tool comprises a depth gauging system for monitoring a depth at which the expander tool is located.

6. The method of claim 2, wherein the expander tool comprises a body, an expansion member capable of being actuated outwardly from the body when expansion of the tubular is desired, and a proximity sensor for determining a position of the expansion member relative to the body.

7. The method of claim 2, wherein the expander tool comprises a body and an expansion member capable of being actuated outwardly from the body when expansion of the tubular is desired, the expander tool is a rotary expander tool, and the expansion member is a plurality of hydraulically actuated, outwardly extendable rollers.

8. The method of claim 2, wherein the expander tool comprises a second sensor for sensing a wall dimension proximate a leading edge of the expander tool.

9. The method of claim 2, wherein the work string or the expander tool comprises a second sensor for sensing a wall dimension.

10. The method of claim 9, wherein said second sensor for sensing the wall dimension is a caliper log.

11. The method of claim 2, wherein said sensor is a sonic log.

12. The method of claim 2, wherein said sensor is an electromagnetic thickness tool.

13. The method of claim 2, further comprising a pressure gauge for measuring a fluid pressure proximate to or within the body of the expander tool.

14. The method of claim 2, wherein the expander tool comprises a body, an expansion member capable of being actuated outwardly from the body when expansion of the tubular is desired, and a pressure differential gauge for measuring a difference in external and internal fluid pressure within the body of the expander tool.

15. A method of utilizing an expander tool in conjunction with a sensor disposed in front of the expander tool in a wellbore, comprising:

running the expander tool with the sensor to a predetermined depth in the wellbore;

activating the expander tool and urging an expansion unit outward in order to expand a tubular therearound past an elastic limit of the tubular; and detecting with the sensor a wall dimension proximate a leading edge of the expander tool.

16. The method of claim 15, further comprising adjusting operation of the expander tool based on the wall dimension.

17. An apparatus for expanding a tubular, comprising:

an expander tool for insertion into a wellbore, the expander tool including at least one extendable member constructed and arranged to selectively contact a tubular wall around the expander tool and to expand the wall past an elastic limit of the wall; and at least one wall dimension sensor disposed in front of and connected to the expander tool for gathering information relative to a wall dimension proximate a leading edge of the expander tool.

18. The apparatus of claim 17, further comprising:

a second sensor for sensing a wall thickness of the tubular as the tubular is expanded.

19. The apparatus of claim 17, further comprising a depth gauging system for monitoring a depth at which the expander tool is located.

20. The apparatus of claim 17, further comprising a second sensor for sensing a thickness of the tubular wall as the tubular wall is expanded, wherein the second sensor for sensing the wall thickness is a sonic log.

21. The apparatus of claim 17, further comprising a second sensor for sensing a thickness of the tubular wall as the tubular wall is expanded, wherein the second sensor for sensing the wall thickness is an electromagnetic thickness tool.

* * * * *